United States Patent [19]

Hunter

[11] Patent Number: 4,568,024

[45] Date of Patent: Feb. 4, 1986

[54] OSCILLATING SPRINKLER

[76] Inventor: Edwin J. Hunter, 5551 Codorniz Rd., Rancho Sante Fe, Calif. 92067

[21] Appl. No.: 515,802

[22] Filed: Jul. 21, 1983

[51] Int. Cl.[4] ..... B05B 3/16

[52] U.S. Cl. ..... 239/242

[58] Field of Search ..... 74/457, 462, 460, 98; 239/242

[56] References Cited

U.S. PATENT DOCUMENTS

| | | | |
|---|---|---|---|
| 820,789 | 5/1906 | Hutchins | 74/460 |
| 2,808,732 | 10/1957 | Champion, Sr. | 74/462 |
| 3,107,056 | 10/1963 | Hunter | 239/242 |
| 3,116,651 | 1/1964 | Hardy | 74/462 X |

FOREIGN PATENT DOCUMENTS

| | | | |
|---|---|---|---|
| 0069357 | 5/1980 | Japan | 74/460 |

*Primary Examiner*—Andres Kashnikow
*Assistant Examiner*—Daniel R. Edelbrock
*Attorney, Agent, or Firm*—Baker, Maxham, Callan & Jester

[57] ABSTRACT

A gear driven oscillating sprinkler head includes a shifting gear train for transmitting drive from a drive motor to the oscillating sprinkler head with a shifting mechanism for shifting alternate driving pinions into driving engagement with an internal ring gear with the pressure angle of the engaging teeth being different for the different drive pinions to thereby balance the shifting force applied by the shifting mechanism.

20 Claims, 6 Drawing Figures

OSCILLATING SPRINKLER

BACKGROUND OF THE INVENTION

The present invention relates to sprinklers and pertains more particularly to gear driven oscillating sprinklers.

In my prior U.S. Pat. No. 3,107,056 issued Oct. 15, 1963, entitled "SPRINKLER", I disclose a gear driven oscillating pop up type sprinkler. In that patent the drive train includes a shifting mechanism that alternately shifts a pair of terminal gears carried on a shifting plate into and out of engagement with an internal gear at the ends of the oscillating stroke. In adapting that drive system to more compact higher pop up stroke higher volume sprinklers, certain problems with the shifting mechanism were encountered.

The chief difficulty encountered was the different engaging and shifting forces present in the shifting mechanism. The shifting mechanism has a very strong self-engaging force when turning in the same direction as the input drive. A great deal of force is required to disengage the drive and shift to the opposite direction. The torque of the input gear to the shifting mechanism adds to the force that tends to hold the assembly into engagement and adds to the force required to disengage the gears at the end of the stroke. However, when rotating in the opposite direction, that is the ring gear is rotating in the direction opposite that of the input drive gear, the torque of the input gear tends to disengage the terminal gear driving it in that direction from the ring.

It has been found that these forces are affected by the pressure angle of the mating teeth between the driving pinions and the ring gear.

It is therefore desirable that an improved drive train be available which properly balances the engaging and disengaging forces of the shift and drive assembly.

SUMMARY AND OBJECTS OF THE INVENTION

It is therefore the primary object of the present invention to provide an improved oscillating drive train for a sprinkler.

In accordance with the primary aspect of the present invention, an oscillating gear drive train for an oscillating sprinkler head includes a first pinion shiftable into engagement with an internal gear for driving in one direction and a second pinion shiftable into engagement with the gear for driving in the opposite direction with the mating teeth of the first and second pinions and the opposite faces of the teeth of the ring gear being selected to have different angles with such angles selected to provide a substantial balance of the engaging and shifting forces affecting the driving and shifting of the drive train.

BRIEF DESCRIPTION OF THE DRAWINGS

The above and other objects and advantages of the present invention will become apparent from the following description when read in conjunction with the drawings wherein:

Turning to FIG. 1 of the drawing a sprinkler unit designated generally by the numeral 10 includes a generally cylindrical housing 12 having an inlet opening at the bottom, not shown, which is connectable to a source of water such as a fixed water line or the like 14. The sprinkler unit includes a typical drive motor 16 such as a water turbine or the like which is drivingly coupled through a gear train 18, the details of which are not shown, for driving an oscillating drive gear train as will be subsequently disclosed and discussed which is contained within an oscillating drive unit 20. The oscillating drive unit 20 is in the form of a generally cylindrical housing mounted in the upper end of the cylindrical housing 12 and is coupled through a hollow or tubular drive shaft 22 to a sprinkler head or nozzle unit 24. The nozzle unit 24 is mounted for rotation with the shaft 22 for rotating about the axis thereof. The shaft 22 is also tubular and serves as a water flow conduit for conveying water to the nozzle unit 24 from the oscillating unit 20.

The basic drive arrangement is substantially like that disclosed in my prior U.S. Pat. No. 3,107,056, patented Oct. 15, 1963 and entitled "SPRINKLER". That patent also discloses the pop up type sprinkler for which the present drive system is adaptable. The contents of that patent are incorporated herein by reference as though fully set forth.

Figure 2:
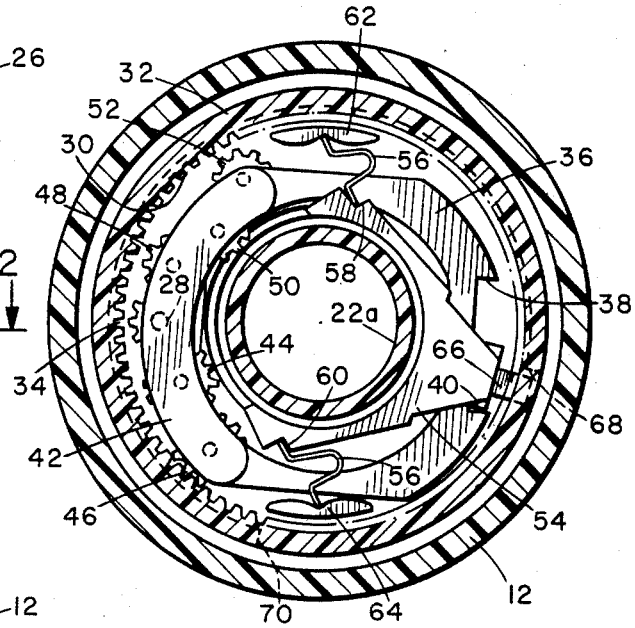
FIG. 2 is an enlarged sectional view taken on line 2—2 of FIG. 1.
Figure 3:
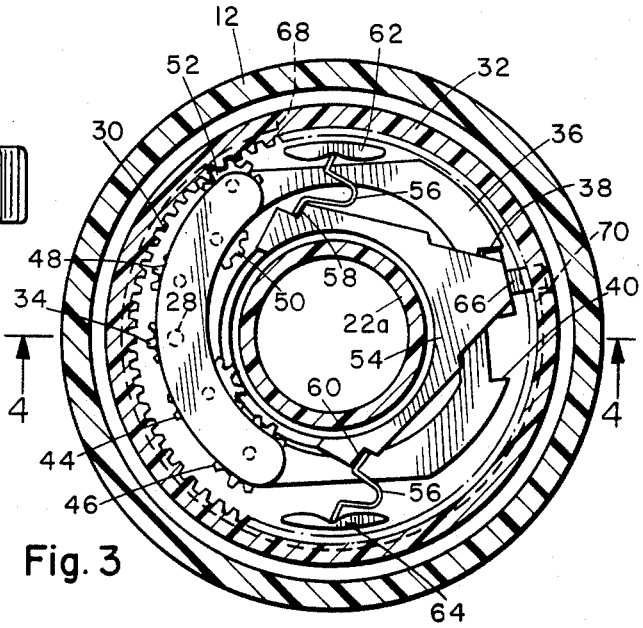
FIG. 3 is a similar sectional view with a drive direction reversed.
Figure 4:
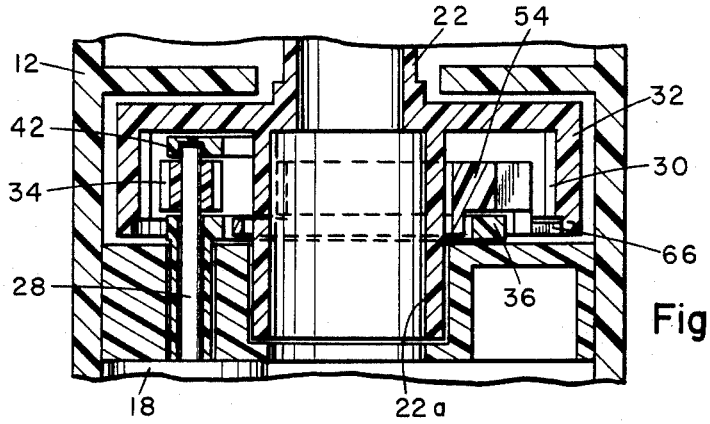
FIG. 4 is a sectional view taken on line 4—4 of FIG. 3.

The oscillating drive assembly is best illustrated in FIGS. 2 through 4 and includes an input shaft 28 which is mounted for rotation about an axis positioned parallel to the central axis of the rotatable member 22 but positioned between that axis and an internal gear 30 formed on the downwardly turned skirt portion 32 of the output drive unit 20 member 32 including the rotating shaft 22. An input pinion gear 34 is mounted on the shaft 28 for rotating therewith and for driving a pair of gear trains as will be described.

Figure 1:
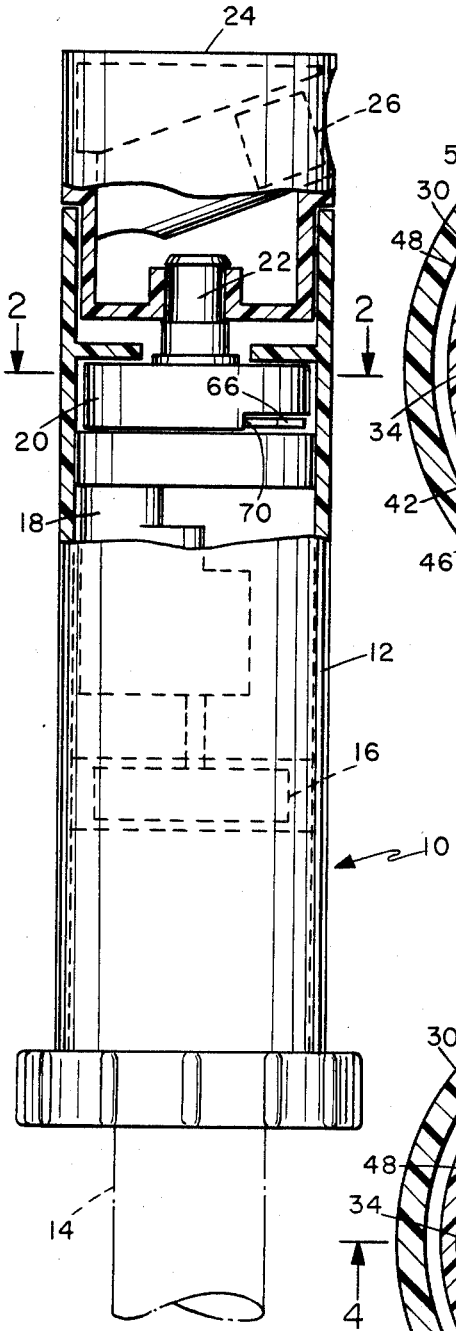
FIG. 1 is a side elevation view partially cut away of a typical sprinkler unit incorporating the gear drive assemblies.

A shifting yoke including a lower annular plate 36 surrounds the central drive shaft 22 and is pivotally mounted on the shaft 28 for pivotal movement about the axis thereof. The shiftable yoke plate 36 includes a pair of oppositely directed shoulders 38 and 40 for engagement as will be described. The yoke assembly includes an upper plate 42 which is also pivotally mounted on the shaft 28, and a first gear train including a idler gear 44 and an outer or terminal pinion gear 46 for drivingly engaging the internal gear 30 for driving it in a counterclockwise direction. A second gear train includes a first idler gear 48 drivingly engaging a second idler gear 50 which drives a terminal gear 52 which drivingly engages the internal ring gear 30 for driving the ring gear in the clockwise direction as seen in FIGS. 1 and 3. The yoke assembly including the plate 36 pivots about the axis of shaft 28 for pivoting to alternate positions as shown respectively in FIGS. 2 and 3 for shifting the alternative drive trains selectively into driving engagement with the internal ring gear 30 for driving the ring gear in alternate directions.

Figure 5:
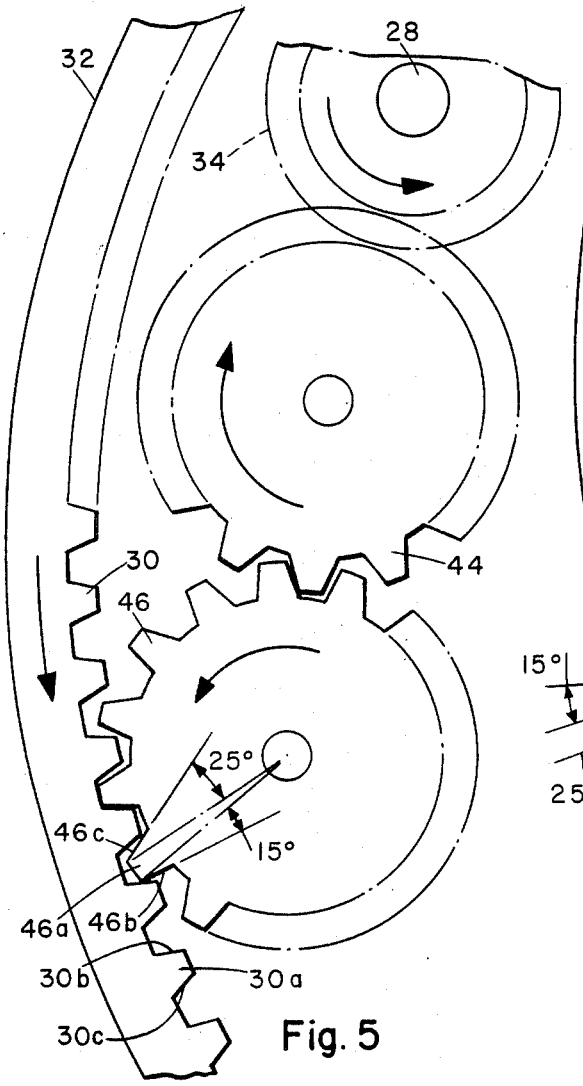
FIG. 5 is a greatly enlarged view of the ring gear and pinion drive coupling as shown in FIG. 2.

As shown in FIG. 2, the first gear train including idler gear 44 and terminal drive gear 46 are in driving engagement with the internal ring gear 30 such that the ring gear is driven by the gear 46 in a counterclockwise direction as shown in FIG. 5.

Figure 6:
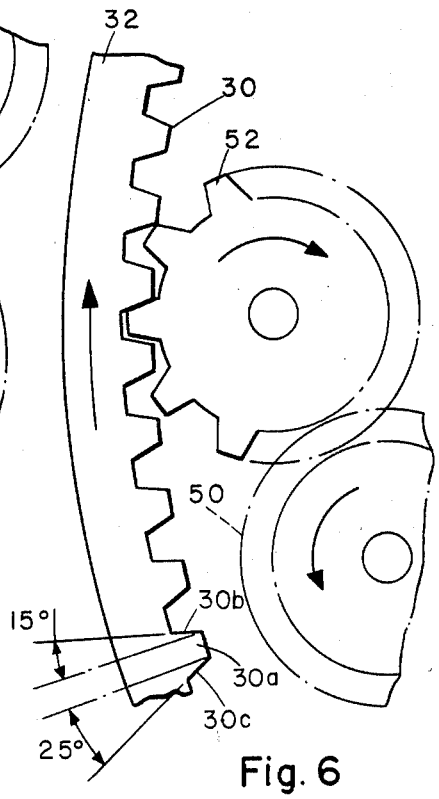
FIG. 6 is a similar view of the ring gear and pinion coupling as shown in FIG. 3.

Referring to FIG. 3, the shifting yoke 36 has been tilted in the opposite direction such that the terminal drive gear 52 is in driving engagement with the internal ring gear 30 for driving the ring gear in the clockwise direction with the input gear 34 driven in the counterclockwise direction as shown in FIGS. 3 and 6.

The shifting yoke 36 is pivoted about the axis of shaft 28 by means of a shifting lever 54 which is rotatably mounted on the lower tubular extension 22*a* of the shaft 22 with a pair of identical overcenter springs 56 engaging notches 58 and 60 on opposite sides of the lever 54 and engaging notches 62 and 64 on extensions of the housing 12.

An outer tip 66 of the lever 54 is engaged by opposing shoulders 68 and 70 on the ring gear 30 for shifting it about its axis. This shifts the overcenter springs for forcing the lever 54 to engage shoulders 38 and 40 and force the shifting yoke 36 to pivot about its axis 28. This shifts alternate ones of the gears 46 and 52 into driving engagement with the internal ring gear 30.

At the position as shown in FIG. 2, the lever 54 has just been forced overcenter in a clockwise direction under engagement by shoulder 68 of the ring gear thereby shifting the yoke 36 to shift gear 46 into driving engagement with the ring gear 30 with the result that the ring gear now begins to turn in the counterclockwise direction until shoulder 70 engages the lever tip 66 of lever 54 shifting it in the counterclockwise direction as shown in FIG. 3 to thereby shift the gear 46 out of engagement with the ring gear and the gear 52 into driving engagement. Continued rotation of the input gear 34 then immediately reverses direction of the ring gear 30 forcing it to begin rotating in the clockwise direction. The stroke of the drive and the angle of coverage of the resulting output will be determined by the angle of the slot between shoulders 68 and 70.

Turning to FIGS. 5 and 6, the balancing gear construction is illustrated. It will be appreciated when viewing FIGS. 2 and 3 that a counterclockwise rotation of the input gear 34 results in counterclockwise torque being applied to the shifting yoke tending to shift it about the axis of the shaft 28 tending to force gear 46 out of engagement with the ring gear 30 and tending to force the pinion gear 52 tighter into engagement with the ring gear 30. These forces are balanced in the present construction as shown in FIGS. 5 and 6 by first constructing the ring gear 30 to have teeth 30*a* that have a face 30*b* having a 15 degree angle and a face 30*c* having a 25 degree angle. The respective mating gears 46 and 52 each are provided with gear teeth that have corresponding angles of face or engagement.

Gear 46, for example, includes a gear tooth 46*a* having a 15 degree angular face 46*b* which drivingly engages the 15 degree face 30*b* of gear tooth 30*a* when driving the gear 30 in the counterclockwise direction. The face 46*c* may be formed to have a 25 degree angle for the purposes of proper mating with the corresponding 25 degree face 30*c* of the ring gear 30. The above angles are by way of illustration only and are not intended to be limitations. It will be apparent that the angles may be above or below these as the conditions may require.

The terminal driving pinion gear 52 is provided with teeth having a 25 degree angle on both faces, such that when driving the ring gear 30 in the counterclockwise direction as shown in FIG. 3 the teeth engage the 25 degree angle face of the teeth 30*a* of the ring gear 30. This angle of the face of engagement between the gears affects the direction of force on the respective gear thereby balancing the forces on the shifting yoke for thereby substantially balancing the shifting forces necessary to shift the drive into and out of the respective drive positions.

As will be appreciated, the greater the angle between the mating gears the greater the outward force on the gear 52, for example, tending to counteract the torque applied to the shifting yoke by the input shaft 28. In a similar manner, the smaller angle 30*b* of the teeth on the ring gear 30 when engaged by the face 46*b* of a similar 15 degree angle results in a less outward force on the gear 46. This less outward force is added to the torque already applied by the input gear 34 and shaft 28. Thus, the overall force acting to shift the gear 46 outward out of engagement with the gear 30 or to maintain it into engagement is substantially balanced to be substantially the same as that acting on the terminal drive gear 52.

These balanced forces as a result of the tooth pressure angles tend to reduce the forces necessary to drive and shift the assembly and tend to reduce the resulting destructive forces thereon.

Thus, while I have illustrated and described my invention by means of specific embodiments, it is to be understood that numerous changes and modifications may be made therein without departing from the spirit and scope of the invention as defined in the appended claims.

I claim:

1. An oscillating sprinkler, comprising:

a sprinkler head mounted for rotation about a first axis;

a drive motor;

a gear train for drivingly connecting said drive motor for driving said sprinkler head including an internal gear connected to said sprinkler head, shiftable drive means having a pair of alternatively operable terminal gears alternatively engageable with said internal gear for driving said internal gear in alternate directions, each terminal gear having a different pressure angle of engagement with said internal gear when each one of said terminal gears is alternately engaged with said internal gear for balancing the engaging forces thereof.

2. The sprinkler of claim 1 wherein said shiftable drive means includes a drive gear driven by said drive motor, said drive gear mounted for rotation about a second axis offset from said first axis, a pivoting yoke mounted for pivotal movement about said second axis, one of said terminal gears mounted on said yoke on one side of said second axis, and the other of said drive gears mounted on said yoke on the other side of said second axis.

3. The sprinkler of claim 2, wherein said internal gear comprises teeth having a first pressure angle on one side and a second pressure angle on the other side, and said first and second pressure angles match said angles of engagement of said terminal gears.

4. The sprinkler of claim 3, wherein the one of said terminal gears for driving said internal gear in a common direction with said drive gear has the lesser of said pressure angles.

5. The sprinkler of claim 4, wherein the lower of said pressure angles is about 15 degrees and the greater of said pressure angles is about 25 degrees.

6. The sprinkler of claim 1 wherein said internal gear comprises teeth having a first pressure angle on one side and a second pressure angle on the other side, and said first and second pressure angles match said angles of engagement of said terminal gears.

7. The sprinkler of claim 1 wherein, the one of said terminal gears for driving said internal gear in a common direction with said drive gear has the lesser of said pressure angles.

8. The sprinkler of claim 7, wherein the lesser of said pressure angles is about 15 degrees and the greater of said pressure angles is about 25 degrees.

9. The sprinkler of claim 7, wherein the difference between said pressure angles is about 10 degrees.

10. The sprinkler of claim 1, wherein the pressure angle of one of said terminal gears is about 15 degrees and the pressure angle of the other terminal gear is about 25 degrees.

11. An oscillating sprinkler, comprising:

a sprinkler head mounted for rotation about a first axis;

a drive motor a shiftable gear train including a pair of terminal drive gears for drivingly connecting said drive motor for driving said sprinkler head including an internal gear connected to said sprinkler head, shiftable means for alternatively shifting said terminal gears alternatively into engagement with said internal gear for driving said internal gear in alternate directions, each terminal gear having a different pressure angle of engagement with said internal gear for balancing the engaging forces thereof, said shiftable drive means includes a drive shaft driven by said drive motor and a gear mounted for rotation about a second axis offset from said first axis, a pivoting yoke mounted for pivotal movement about said second axis, one of said terminal gears mounted on said yoke on one side of said second axis, and the other of said drive gears mounted on said yoke on the other side of said second axis.

12. The sprinkler of claim 11, wherein said internal gear comprises teeth having a first pressure angle on one side and a second pressure angle on the other side, and said first and second pressure angles match said angles of engagement of said terminal gears.

13. The sprinkler of claim 12, wherein the one of said terminal gears for driving said internal gear in a common direction with said drive gear has the lesser of said pressure angles.

14. The sprinkler of claim 13 wherein the lesser of said pressure angles is about 15 degrees and the greater of said pressure angles is about 25 degress.

15. The sprinkler of claim 13 wherein the difference between said pressure angles is about 10 degrees.

16. A balanced oscillating gear drive for a sprinkler head comprising:

an internal gear having teeth with a first pressure angle on one face and a second different pressure angle on the other face;

a drive gear, a shifting yoke pivotally mounted co-axially of said drive gear, a first gear train driven by said drive gear and including a drive pinion for selective engagement with said internal gear for driving said internal gear in a first direction of rotation; and a second gear train driven by said drive gear and including a drive pinion for selective engagement with said internal gear for driving with internal gear in a second direction, one of said first and second drive pinions having teeth matching the first of said pressure angles and the other of said drive pinions having teeth matching the second of said pressure angles for substantially balancing the engaging force on said gear.

17. The sprinkler of claim 16, wherein the one of said terminal gears for driving said internal gear in a common direction with said drive gear has the lesser of said pressure angles.

18. The sprinkler of claim 17 wherein the lesser of said pressure angles is about 15 degrees and the greater of said pressure angles is about 25 degrees.

19. The sprinkler of claim 17, wherein the difference between said pressure angles is about 10 degrees.

20. The sprinkler of claim 17, wherein the first and second pressure angles are about 15 degrees and 25 degrees respectively.

* * * * *